US005275115A

United States Patent [19]

Houston

[11] Patent Number: 5,275,115

[45] Date of Patent: Jan. 4, 1994

[54] FUME INCINERATOR WITH VACUUM BAFFLE

[76] Inventor: Reagan Houston, 252 Foxhunt La., Hendersonville, N.C. 28739

[21] Appl. No.: 30,820

[22] Filed: Mar. 12, 1993

[51] Int. Cl.[5] ..... F23B 5/00

[52] U.S. Cl. ..... 110/211; 110/212; 422/182; 431/5; 431/215; 432/72

[58] Field of Search ..... 422/182; 110/210, 211, 110/212, 213; 431/5, 215; 432/72

[56] References Cited

U.S. PATENT DOCUMENTS

| | | | |
|---|---|---|---|
| 3,656,441 | 4/1972 | Grey et al. . | |
| 3,898,040 | 8/1975 | Tabak . | |
| 4,716,725 | 1/1988 | Dettling et al. | 422/182 X |
| 4,741,885 | 5/1988 | Herbort et al. . | |
| 4,771,707 | 9/1988 | Robson et al. | 110/211 |
| 5,161,966 | 11/1992 | Obermueller | 432/22 |

OTHER PUBLICATIONS

Ser. No. 920,245, Jul. 1992 Thomason.

*Primary Examiner*—Edward G. Favors

*Attorney, Agent, or Firm*—Carter and Schnedler

[57] ABSTRACT

A single unit, shell and tube fume incinerator utilizes a vacuum baffle (34) structure proximate a combustion zone (24) to control the flow of combustion exhaust gas. The vacuum baffle (34) is located slightly above the hot ends of a plurality of heat exchange tubes (20) to deflect the hot exhaust gases from the combustion zone (24) away from the ends of the tubes (20), and back to the outside of the tubes (20), thereby controlling the "time at temperature" for contaminants in the impure gas feed. A vacuum effect is created just below the baffle (34) to draw cleansed exhaust below the baffle (34) back up into the combustion zone (24) to prevent the escape of impure gas.

5 Claims, 1 Drawing Sheet

FUME INCINERATOR WITH VACUUM BAFFLE

BACKGROUND OF THE INVENTION

The present invention relates generally to incinerator systems for the abatement of process emissions containing carbonaceous impurities such as volatile organic combustibles (VOC).

Noxious fumes, waste gases or process emissions, which may be termed "feed gas", "waste gas" or "emissions" generally contain volatile organic combustible (VOC) contaminants (carbonaceous impurities). However, the amount of combustible material contained in such emissions is generally below several thousand ppm, and accordingly, will not ignite or propagate a flame at ambient temperature.

Incinerators increase the temperature of such emissions to a level above the ignition temperature of the combustible contaminants by the use of heat derived from a supplemental energy source thereby to oxidize the emission. Regenerative incinerators recover heat remaining in the cleansed exhaust gas to increase the temperature of emissions entering the incinerator thereby minimizing the amount of fuel used by the supplemental energy source to raise the emission to its ignition temperature.

In a typical single unit shell and tube heat exchanger the impure gases flow upwardly through the interior of a plurality of tubes to a combustion chamber. The plurality of tubes are generally affixed to the incinerator as by welding to a tube sheet proximate the combustion chamber. Fuel is burned in the combustion chamber which typically raises the temperature of the impure gases to about 1400° F. (760° C.) where the VOC's are oxidized to $CO_2$ and $H_2O$. The hot gases are then returned to the heat exchanger by downwardly flowing around the outside of the plurality of tubes. However, impure gas flow into the combustion chamber from the ends of the tubes is generally not controlled so as to create a "mixing" effect within the combustion chamber. Because there is no flow control, the amount of time the impure gas remains in the combustion chamber (i.e., "time at temperature") will vary throughout the abatement cycle. A varying "time at temperature" for the impure gas can create the problem of incomplete oxidations of the VOC's.

OBJECTS OF THE INVENTION

It is therefore an object of the present invention to provide an improved single unit regenerative incinerator which provides a flow control for cleansed exhaust which also prevents leakage of any contaminants thereby achieving complete oxidation of contaminates.

It is also an object of the present invention to provide a single unit regenerative incinerator which provides a structural flow control for combustion chamber exhaust without permitting contaminant leakage from the combustion chamber.

SUMMARY OF THE INVENTION

The present invention provides a fume incinerator which comprises a housing having an upper and lower end, a tube sheet internally affixed to the housing for defining a plenum in the lower end of the housing, and an inlet pipe for feeding ambient fumes containing volatile organic combustible contaminants into the plenum. A combustion chamber is located in the upper end of the housing for oxidizing the volatile organic combustible contaminants in the fumes and outputting a hot exhaust. A burner is attached to the combustion chamber for admitting a combustion fuel into the combustion chamber. A plurality of heat exchange tubes are affixed to the tube sheet for delivering the fumes in the plenum to the combustion chamber, and an outlet pipe is connected to the housing, intermediate the lower and upper ends, for expelling the hot exhaust. A baffle is affixed to the housing proximate the combustion chamber for evenly directing the hot exhaust between the housing and the outer surfaces of the plurality of tubes to the outlet pipe, thereby heating the ambient fumes inside the plurality of tubes and cooling the hot exhaust. The ends of the plurality of tubes proximate the combustion chamber inject the fumes at a substantial flow velocity of at least forty feet per second into the combustion chamber through a corresponding plurality of holes located in the baffle, thereby creating a vacuum to prevent any leakage of the fumes from the combustion chamber. In further accordance with the present invention, each end of the plurality of tubes proximate the combustion chamber is constricted to form a nozzle.

BRIEF DESCRIPTION OF DRAWING

The subject matter which is regarded as the invention is set forth in the appended claims. The invention itself, however, together with further objects and advantages thereof, may be better understood with reference to the following description taken in conjunction with the accompanying drawings, in which:

DESCRIPTION OF THE PREFERRED EMBODIMENT

Figure 1:
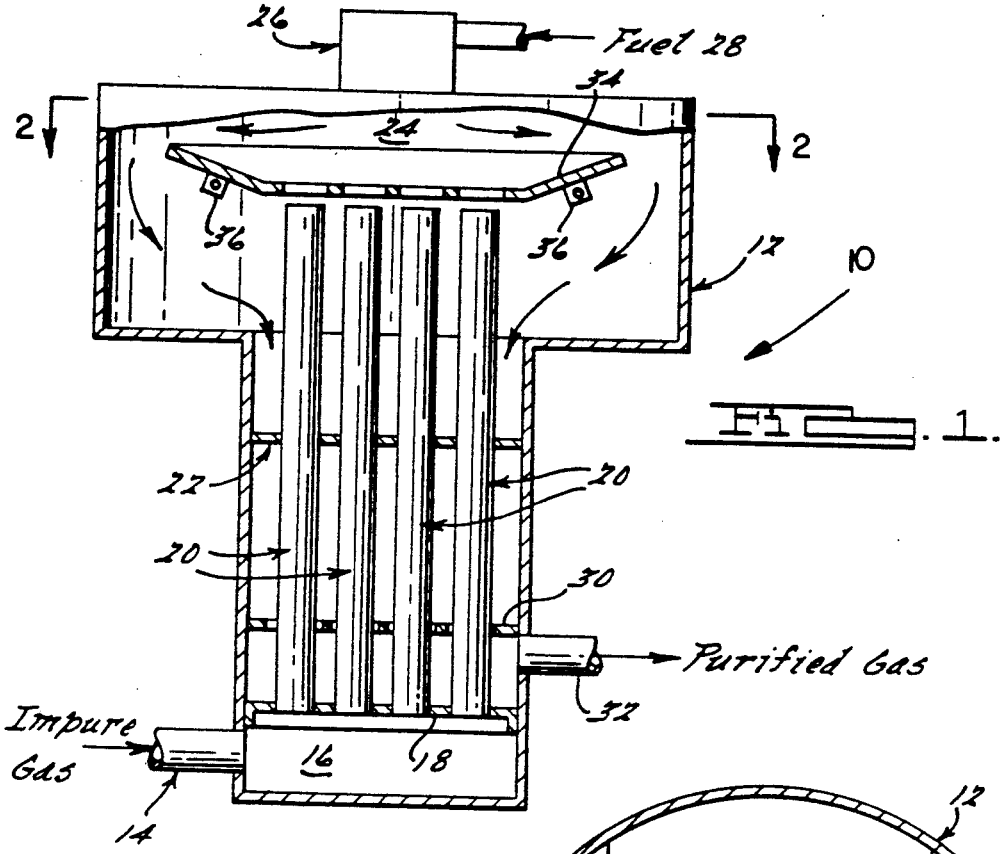
FIG. 1 is a side elevational view, partially in section, of a fume incinerator utilizing an impinged vacuum baffle in accordance with the present invention.
Figure 2:
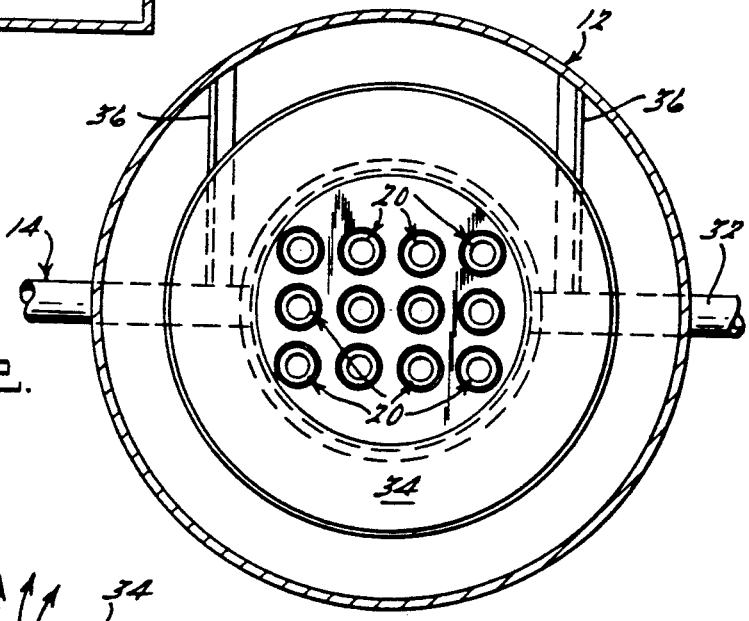
FIG. 2 is a cross-sectional view taken along the line 2—2 of FIG. 1.

Referring to FIG. 1, a single unit, shell and tube fume incinerator 10 in accordance with the present invention comprises an enclosure or housing 12 having an inlet pipe 14 and a plenum 16 at the lower end thereof. A tube sheet 18 at the lower end of a set of tubes 20 affixes the lower end of the tubes to the enclosure 12. Tubes 20 can be cylindrical as shown, or square shaped. The top ends of the tubes are guided against excessive lateral motion by a set of transverse support members 22. The support members 22 are affixed to the housing 12 as by welding. The impure gases are input into plenum 16 from inlet pipe 14. The gases then flow into tubes 20 and subsequently injected from the ends of tubes 20 into a combustion chamber 24. To promote mixing in the chamber 24, the top ends of tubes 20 can be constricted to form nozzles 25 (shown in FIG. 3). A burner 26 regulates and supplies a fuel 28 to combustion chamber 24, which heats the gases within the chamber 24 to a desired combustion temperature. Generally, a suitable combustion temperature is approximately 1400° F. (760° C.). As the gases flow downwardly, they pass uniformly over the outside (i.e., the outer perimeter) of all of the tubes 20, thereby creating a heat exchange effect. Overall operation will be explained in more detail hereinbelow.

The gases from the combustion chamber 24 begin to cool as soon as they enter the space around the tubes 20 due to a counterflow heat exchange process. The housing 12 surrounding the bundle of tubes has a diameter such that the gas velocity outside of tubes 20 is about the same as the velocity inside of tubes 20. This provides a beneficial balance between pressure drop and heat transfer inside incinerator 10. The effective heat transfer area is determined by the amount of area within housing 12 having tubes 20 extending therein. This area defines the counterflow heat exchanger.

To facilitate removal of the cleansed exhaust gas from incinerator 10, a lower baffle 30 is disposed just above the tube sheet 18 to convert the uniform downward exhaust gas flow to a controlled horizontal flow. The controlled horizontal exhaust gas flow exits incinerator 10 at a heat exchanger vent pipe 32. The tubes 20 extend through corresponding openings cut into lower baffle 30. To generate the desired fast flow conversion, the diameters of the openings are progressively decreased in size with the largest diameter opening being the furthest away from vent pipe 32. The progressively decreasing diameter sizes create progressively decreasing clearances between tubes 20 and the lower baffle openings. The decreasing clearances cause changes in gas flow pressure thereby converting the uniform downward gas flow to a controlled horizontal gas flow.

In accordance with the present invention, an upper vacuum baffle 34 is affixed to the housing 12 as by a suitable structural fastening means, e.g., flange/bolt combinations 36. Upper vacuum baffle 34 is utilized to control the flow of hot exhaust gas from the combustion chamber 24. Vacuum baffle 34 can be flat, tubular, or conical (as shown in FIG. 1) to add stiffness. Below the upper baffle 34, the housing 12 constricts exhaust gas flow so that the hot air which has passed around the upper vacuum baffle 34 must generally flow into the outer perimeter of the tube bundle (i.e., the space between tubes 20 and housing 12).

Figure 3:
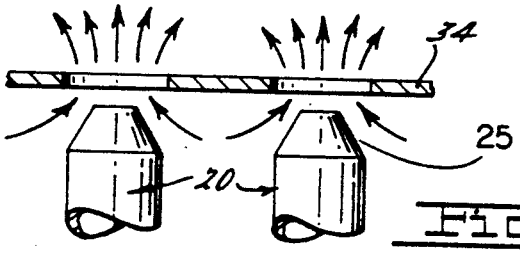
FIG. 3 is a detailed partial view of the vacuum baffle of the present invention.

In accordance with the present invention, upper vacuum baffle 34 prevents the leakage of impure gas through the upper baffle. As shown in FIG. 3, the holes in vacuum baffle 34 are located slightly above the ends of the tube nozzles 25. With the increased velocity, impure gas jets through the holes in upper baffle 34, thereby causing a slight vacuum to be created just below upper baffle 34. This vacuum acts to draw cleansed combustion exhaust gas below upper baffle 34 back up into the combustion chamber 24, thereby preventing any escape of impure gas.

Operation of the incinerator 10 will now be more fully described. In accordance with the present invention, impure gases typically containing air, VOC's and perhaps other compounds are fed into the bottom of incinerator 10 to the plenum 16 below the tube sheet 18. A regenerative heat exchange process occurs as the gases rise up the inside of tubes 20. The gases are preheated from ambient temperature (100° F./≈37° C.) to approximately the combustion temperature (≈1200° F./≈648° C.) by the down flowing hotter gases which exit the combustion chamber 24. As the feed gases reach the combustion temperature, the VOC's will start to burn and raise the gas temperature thereof. The combustion temperature varies with the type of impurities but is typically 900° F. to 1200° F. (≈482° C. to ≈648° C.). The fuel 28 (and air) fed to the burner 26 provides enough energy to raise the gas temperature to the desired combustion temperature (typically 1400° F./760° C.). Radiation or flow of the mixing products throughout combustion chamber 24 provides an even temperature within the chamber 24. Combustion is completed in the combustion chamber 24, and in the top portion of tubes 20.

The gas flow from the ends of tubes 20 promotes mixing within combustion chamber 24, particularly when the tubes are constricted to form nozzles 25. However, this gas flow also causes the problem of varying the amount of time the gas (and therefore the VOC's) remain in the combustion chamber 24. This in turn causes difficulty in controlling the "time at temperature" of the gas to ensure complete oxidation of the VOC's. A higher operating temperature can somewhat compensate for a variable or potentially short "time at temperature", but this can lead to damage of tubes 20.

In accordance with the present invention, the use of upper vacuum baffle 34 gives a definite "time at temperature" as the gases flow radially outward, around the edge of the baffle and radially inward without increasing the incinerator operating temperature. Upper baffle 34 ensures the complete combustion of the VOC contaminants. The vacuum effect prevents any VOC leakage from combustion chamber 24. The hot gases then flow downward around the outside of the tubes 20 thereby creating the regenerative heat exchange effect. Since flows are essentially uniform both inside and outside tubes 20, local overheating is minimized.

The present invention particularly improves the oxidation process within a single unit shell and tube heat exchange regenerative incinerator by controlling the flow of combustion chamber exhaust to provide a definite "time at temperature". The present invention is particularly advantageous when utilized with regenerative fume incinerators such as described in Applicant's United States patent applications entitled "Fume Incinerator", Ser. No. 07/904,472, filed on Jun. 25, 1992, and "Fume Incinerator for Abatement of Contaminants, Nitric Oxides, Chlorides and Sulfides", Ser. No. 07/904,467, filed on Jun. 25, 1992, incorporated by referenced herein.

It will be understood that the foregoing description of the preferred embodiment of the present invention is for illustrative purposes only, and that the various structural and operational features herein disclosed are susceptible to a number of modifications none of which departs from the spirit and scope of the present invention as defined in the appended claims.

What is claimed is:

1. A fume incinerator comprising:

a housing having an upper and lower end;

an inlet for feeding ambient fumes containing volatile organic combustible contaminants into the lower end of said housing;

a combustion chamber;

a plurality of heat exchange tubes affixed to the lower end of said housing, said plurality of tubes delivering said ambient fumes from the lower end of said housing to said combustion chamber; each of said tubes having an open end located near said combustion chamber;

an outlet connected intermediate the lower and upper ends of said housing for expelling exhaust from said incinerator;

a baffle within said housing positioned between said combustion chamber and said open ends of said tubes;

a plurality of holes in said baffle; said baffle directing hot exhaust from said combustion chamber between said housing and the outer surfaces of said plurality of tubes to said outlet thereby heating said ambient fumes inside said plurality of tubes and cooling said hot exhaust, wherein the open ends of said plurality of tubes proximate said combustion chamber inject said fumes at a substantial flow velocity into said combustion chamber through said plurality of holes in said baffle, thereby creating a vacuum to prevent leakage of said fumes from said combustion chamber.

2. The fume incinerator of claim 1 wherein each open end of said plurality of tubes proximate said combustion chamber is constricted to form a nozzle.

3. The fume incinerator of claim 1 wherein said flow velocity is at least forty feet per second.

4. The fume incinerator of claim 1 wherein each open end of said tubes are aligned with one of said holes in said baffle.

5. The fume incinerator of claim 1 wherein said open ends of said tubes are located a predetermined distance from said baffle.

* * * * *